US005720379A

United States Patent [19]

Schwartz et al.

[11] Patent Number: 5,720,379

[45] Date of Patent: Feb. 24, 1998

[54] PUSH-PUSH SWITCH WITH LOCK

[75] Inventors: Allen K. Schwartz, Oxford; George S. Vidican, Rochester Hills, both of Mich.

[73] Assignee: ITT Automotive, Inc., Auburn Hills, Mich.

[21] Appl. No.: 743,743

[22] Filed: Nov. 7, 1996

[51] Int. Cl.[6] ..... H01H 1/52

[52] U.S. Cl. ..... 200/318.1; 200/523; 200/525

[58] Field of Search ..... 200/525, 526, 200/527, 528, 523, 318, 318.1, 318.2, 529, 520

[56] References Cited

U.S. PATENT DOCUMENTS

| | | | |
|---|---|---|---|
| 3,691,333 | 9/1972 | Elliott | 200/526 |
| 4,117,743 | 10/1978 | Suzuki et al. | 200/526 |
| 4,464,549 | 8/1984 | Fujita | 200/318.1 |
| 5,380,970 | 1/1995 | Mizuno et al. | 200/524 |

*Primary Examiner*—David J. Walczak

*Attorney, Agent, or Firm*—Thomas N. Twomey; J. Gordon Lewis

[57] ABSTRACT

A switch in one embodiment includes a knob slidable through an aperture in a bezel. The knob is guided within a post mounted on a carrier and is biased to an outward position with respect to a carrier. A latch movably mounted on the carrier is rotated between two positions by a member carried on the knob on each successive depression of the knob. In one position, a projection on the latch extends through aligned bores in the post and a stem carried on the knob to lock the knob in a second position. Movement of the latch in an opposite direction, on the next depression of the knob, releases the projection from the aligned bores enabling the knob to biasingly move outward to the first position. Preferably, the carrier is rotatable relative to a support. The knob is keyed to the post on the carrier such that when the knob is in the second position, rotation of the knob causes rotation of the carrier. In another embodiment, two pushbuttons are disposed side-by-side for independent and/or simultaneous movement. The latch engagable with either or both pushbuttons in the second position.

30 Claims, 4 Drawing Sheets

PUSH-PUSH SWITCH WITH LOCK

BACKGROUND OF THE INVENTION

1. Field of the Invention

The present invention relates, in general, to push—push type switches which change the state of a contact on each depression.

2. Description of the Art

It is known to construct switches or pushbuttons with a push—push operation in which a first push of the switch causes a certain output or action and a second depression of the switch causes a second action, typically a cancellation or deactivation of the first output or action.

It is also known to construct such push—push type switches which lock in a depressed state on one depression and are released from the depressed state to an extended state on an immediately subsequent depression. Such lockable switches are typically of the pin type or spring hook type. However, such switches are sensitive to tolerance variations and bent components.

Thus, it would be desirable to provide a push—push switch with one position lock which overcomes the problems of previously devised switches having similar features. It would also be desirable to provide a push—push type switch with lock which has a simple, reliable construction.

SUMMARY OF THE INVENTION

The present invention is a push—push switch which includes a unique lock to lock the switch in one position on a first depression and to release the switch from the locked position on a subsequent depression of the switch.

In one embodiment, the switch includes a carrier. A knob is movably mounted relative to the carrier. The knob has a stem, and an aperture formed in the stem.

Biasing means is disposed between the carrier and the knob for normally biasing the knob to a first position with respect to the carrier. A member is movably mounted on the carrier. The member includes a projection. The member is movable between first and second positions, with the projection engaged with the aperture in the stem to latch the knob in a second position and disengagable from the aperture in the stem to release the knob for movement of the knob to the first position. Means, operable upon movement of the knob toward the carrier, are provided for moving the member between the first and second positions upon each movement of the knob. Preferably, means are provided for retaining the member in the last of the first and second positions.

The moving means preferably comprises first and second detents formed on the member. Means are carried on the knob for alternately engaging one of the first and second detents upon each movement of the knob.

The push—push switch of the first embodiment of the present invention provides a unique lock which locks the knob in one depressed position. In an exemplary embodiment, when the knob is in the lock depressed position, the outer surface of the knob is flush with a surrounding support to inhibit rotation of the knob. However, when the knob is depressed again, the outer surface of the knob is urged beyond the surface of the support and can be grasped to effect rotation of the knob and contacts carried by the carrier coupled to the knob.

In a second embodiment of the push—push switch of the present invention, the latch is capable of engagement with transverse bores formed in two side-by-side axially moveable pushbuttons. One of the pushbuttons has an outwardly extending flange overlaying the adjacent pushbutton such that a first pushbutton is independently moveable separate from the second pushbutton; however, axial movement of the second pushbutton simultaneously advances the first pushbutton and the second pushbutton when in the first, normal position. The latch is moved between the first and second positions by a finger extending from the first pushbutton and engagable with the latch upon each axial advance of the first pushbutton toward the second position. A detent plunger is engagable with two detents formed on the latch member to biasingly retain the latch member in the last one of the first and second positions of the latch member.

Both embodiments of the push—push switch of the present invention provide a simple switch structure which has minimal tolerance variation sensitivity.

BRIEF DESCRIPTION OF THE DRAWINGS

The various features, advantages, and other uses of the present invention will become more apparent by referring to the following detailed description and drawing in which.

DESCRIPTION OF THE PREFERRED EMBODIMENT

Figure 1:
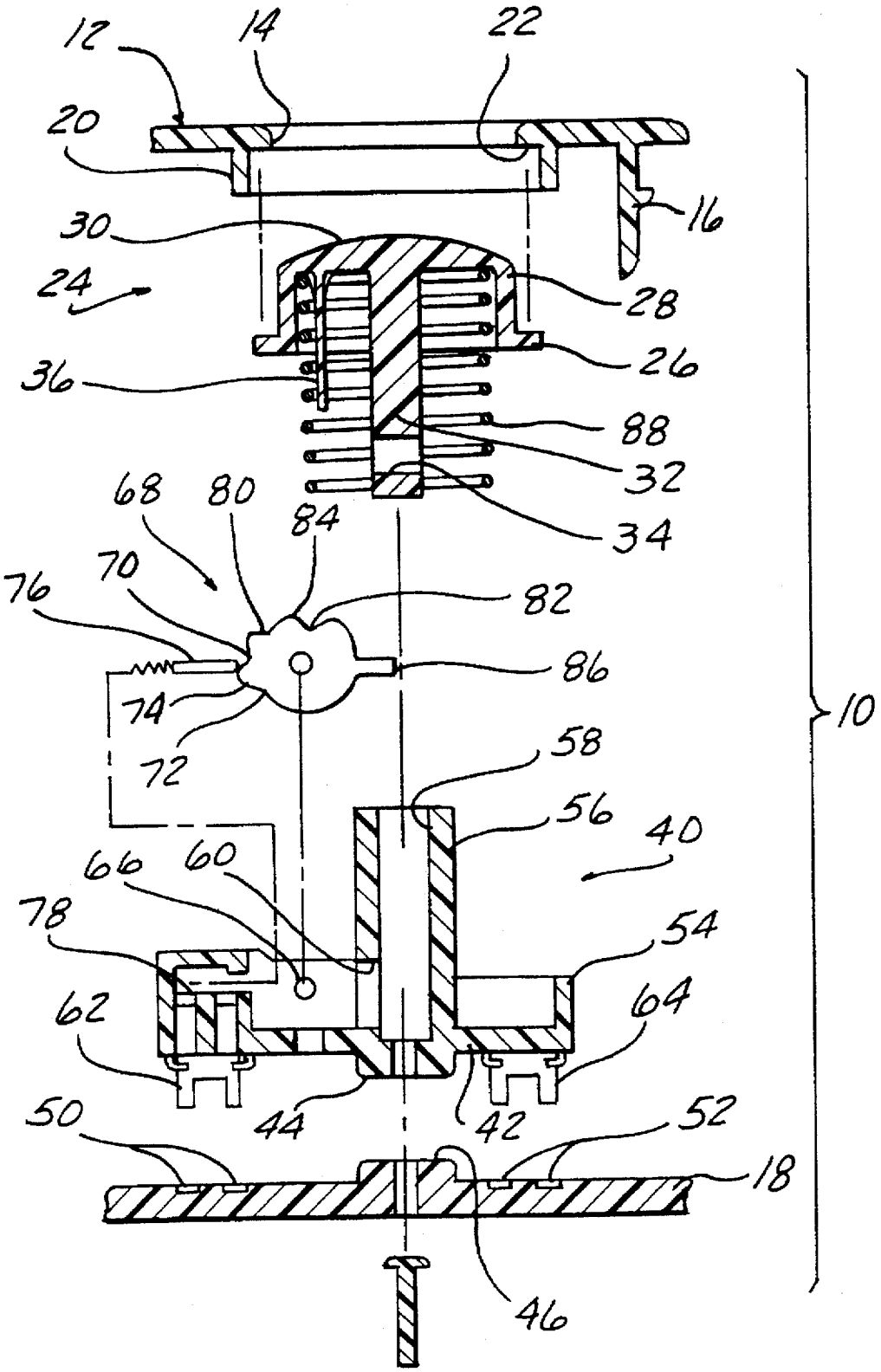
FIG. 1 is an exploded, cross-sectional view of one embodiment of a push—push type switch constructed in accordance with the teachings of the present invention.
Figure 2:
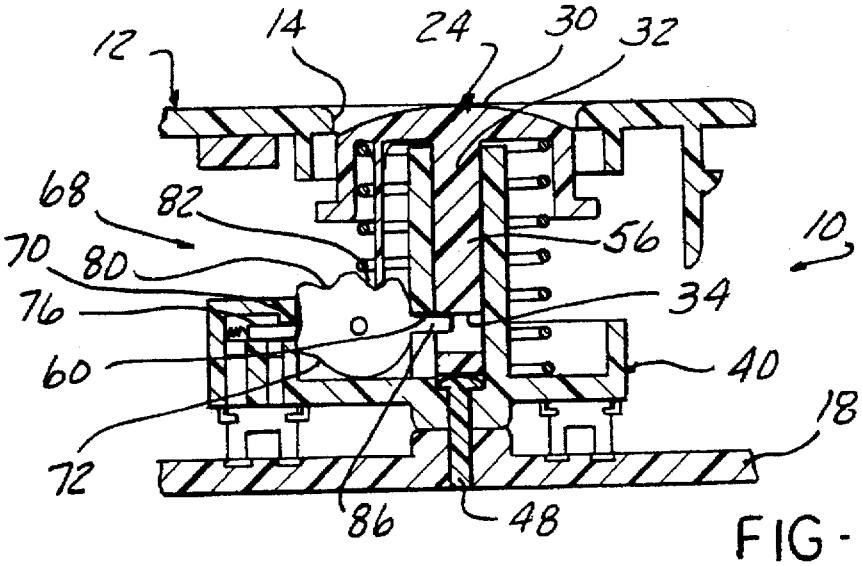
FIG. 2 is an assembled, cross-sectional view of the push—push switch shown in FIG. 1, depicting the switch in a first, locked position.
Figure 3:
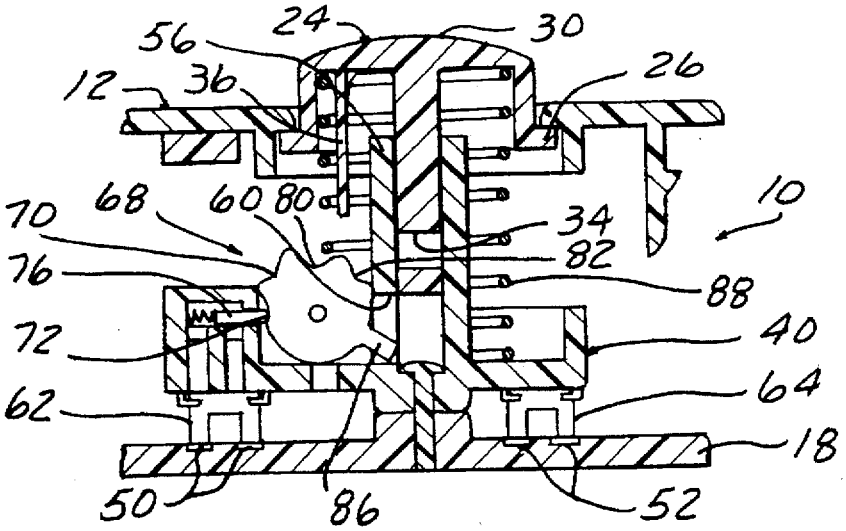
FIG. 3 is a cross-sectional view, similar to FIG. 2, but showing the switch in a second, unlocked position.

Referring now to the drawing, and to FIGS. 1–3 in particular, there is depicted one embodiment of a push—push switch 10 constructed in accordance with the teachings of the present invention.

The switch 10 includes a cover plate or bezel 12 having an aperture 14 and at least one mounting tab 16 which is releasibly engagable with a corresponding receiver, not shown, in a support or surface 18. An annular collar 20 depends from a back surface of the bezel 12 and concentrically surrounds the aperture 14. An annular shoulder 22 is formed on the back surface of the bezel 12 between the outer diameter of the aperture 14 and the inner diameter of the collar 20.

A generally cylindrical knob or pushbutton 24 is formed with a peripheral flange 26 which is sized to slidably fit within the interior of the annular collar 20 in the bezel 12. A cylindrical extension 28 extends from the flange 26 and slidably projects through the aperture 14. The extension 28 terminates in an outer end wall 30. A post 32 depends from the inner surface of the end wall 30 generally centrally within the extension 28. A transverse bore 34 is formed at one end of the post 32.

Also formed as part of the knob 24 is a moving means 36 which, in this embodiment, is in the form of an elongated rod attached by a living hinge integrally extending from the back surface of the end wall 30 of the knob 24.

The knob 24 is movably disposed with respect to a carrier 40. In a preferred embodiment, the carrier 40 is rotatably disposed with respect to the support surface 18. However, it will be understood that carrier 40 can be fixedly positioned such that contact switching is implemented by sliding movement of the knob 24 with respect to the fixed carrier 40.

In the embodiment shown in FIGS. 1–3, the carrier 40 is formed with a base 42 having a raised central boss 44. The boss 44 rides on a similarly formed boss 46 in the support surface 18. A pivot pin 48 projects through apertures in the bosses 44 and 46 to rotatably connect the carrier 40 to the support surface 18. In this embodiment, the support surface 18 includes a printed circuit board having a plurality of conductive traces 50 and 52 formed on an upper surface thereof.

A raised, annular side wall 54 extends from the base 42 of the carrier 40. A guide member 56 extends from the base 42 generally coaxially with the boss 44. The guide member 56 has an internal bore 58 formed of a cross-section complementary to the cross-section of the stem 32 on the knob 24. Preferably, the bore 58 in the guide member 56 is keyed to the stem 32 on the knob 24 to prevent rotation of the knob 24 relative to the carrier 40; but, at the same time to effect simultaneous and equal rotation of both the knob 24 and the carrier 40 together, as described hereafter. The keyed arrangement is provided, in an exemplary embodiment, by forming both the bore 58 in the guide member 56 and the stem 32 with a square cross-section. Other keyed configurations for the bore 48 and the rod 32 are also possible.

A transverse slot 60 is formed in a lower portion of the guide member 56 and projects through the side wall of the guide member 56 into communication with the bore 58.

At least one and, by example only, a pair of contactors 62 and 64 are fixedly mounted on the base 42 of the carrier 40. The contactors 62, in an exemplary embodiment, are each in the form of a pair of bifurcated contacts which electrically engage the conductive traces 50 and 52, respectively, on the support surface 18. Rotation of the carrier 40, as described hereafter, wipes the contactors 62 and 64 across the conductive traces 50 and 52 into and out of contact therewith to complete or open electric circuits connected to the traces so as to selectively apply or disconnect electrical power to output devices connected to certain of the conductive traces 50 and 52.

An aperture 66 in the side wall 54 of the carrier 40 receives a pin to pivotally support a lock member, such as a ratchet 68. The pivot pin, not shown, pivotally mounts the ratchet 68 to the carrier 40 for pivotal movement of the ratchet 68 relative to the carrier 40.

As shown in FIGS. 1–3, the ratchet 68 includes a first pair of detents 70 and 72 disposed on opposite sides of a raised central finger 74. The detents 70 and 72 are selectively engaged by a spring biased detent plunger 76 which is movably disposed in a bore 78 in the carrier 40. The function of the detent plunger 76 is to releasibly hold the ratchet 68 in one of two pivoted positions. Forced rotation of the ratchet 68 from one position to the other will cause movement of the detent plunger 76 out of engagement with one detent 70 or 72, over the central finger 74 and into engagement with the other detent 70 or 72.

A second set of position detents including a first position detent 80 and a second position detent 82 are also formed on the periphery of the ratchet 68 on opposite sides of a central projection 84. The first and second position detents 80 and 82 are designed to be alternately engaged by the rod 36 upon each subsequent depression of the knob 24 as described hereafter.

A lock finger 86 projects radially outward from the ratchet 68 toward the bore 60 in the guide member 56.

A biasing spring 88 is disposed within the interior of the knob 24 and seats between the top wall 30 and the base 42 of the carrier for normally biasing the knob 24 to the second position away from the carrier 40.

The operation of the switch 10 will now be described with reference to FIGS. 2 and 3. FIG. 2 depicts a normal locked position of the knob 24 with respect to the carrier 40. In this position, with the end wall 30 of the knob 24 generally flush or in-line with respect to the outer surface of the bezel 12, the ratchet 68 has been rotated to a first position wherein the lock finger 86 extends through the bore 60 in the guide member 56 on the carrier 40 and into the bore 34 in the stem 32 to lock the stem 32 and the entire knob 24 in the first position.

In order to position the ratchet 68 in the locking position shown in FIG. 2, the knob 24 was previously depressed causing the rod 36 to engage the first position detent 80 and to rotate the ratchet 68 in a counterclockwise direction bringing the latch finger 86 into and through the bore 60 and into engagement with the bore 34 in the stem 32 on the knob 24. The resiliency of the rod 36 due to the living hinge connection enables the rod 36 to follow the rotary movement of the detent 80. In this position, the detent plunger 76 engages the detent 70 to maintain the ratchet 68 in the first locked position.

After the knob 24 is locked in the first position, release of force on the knob 24 will enable a slight amount of travel of the knob 24 until the lock finger 86 fully engages the stem 32. The travel enables the rod 36 to clear the detent 80 and move to an aligned position with the second position detent 82 for engagement on the next depression of the knob 24.

When it is desired to change an output function controlled by the switch 10, the knob 24 is again depressed. This subsequent depression brings the rod 36 carried by the knob 24 into engagement with the second position detent 82. The living hinge or resilient nature of the rod 36 enables the rod 36 to engage and arcuately move the ratchet 68 during depression of the knob 24. Such engagement between the rod 36 and the second position detent 82 causes clockwise rotation of the ratchet 68 thereby moving the latch finger 86 out of the bore 34 in the stem 32 on the knob 24. This enables the biasing spring 88 to urge the knob 24 away from the carrier 40 until the peripheral flange 26 in the knob 24 engages the shoulder 22 on the inner surface of the bezel 12. In this position shown in FIG. 3, the end wall 30 of the knob 24 projects outwardly from the outer surface of the bezel 12. This enables the knob 24 to be grasped by a user to effect rotation of the knob 24 and the carrier 40 keyed thereto and a switching movement of the contactors 62 and 64 over the conductive traces 50 and 52 on the support surface 18.

Obviously, after the desired rotation of the knob 24 and carrier 40 has been completed, the user can depress the knob 24 once again to move the knob 24 back to the first locked position shown in FIG. 2 wherein the end wall 30 of the knob 24 is flush with the bezel 12 to prevent any access to the knob 24 for further rotation thereof.

Figure 4:
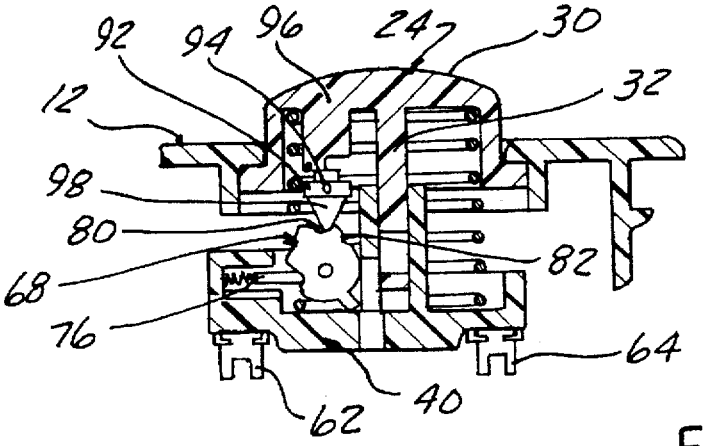
FIG. 4 is a cross-sectional view of another embodiment of the push—push switch of the present invention, shown in the second, unlocked position.

A modification to the embodiment shown in FIGS. 1–3 is depicted in FIG. 4. Substantially all of the switch 10 shown in FIG. 4 is identical to that described above and shown in FIGS. 1–3. Thus, only the differences between the modification shown in FIG. 4 and the first embodiment will be described in detail.

As shown in FIG. 4, the ratchet 68 also includes first and second position detents 80 and 82. In this embodiment, the means for moving or rotating the ratchet 68 includes a moving member denoted generally by reference number 92. The moving member 92 is pivotally mounted by a pivot pin 94 to an extension 96 projecting from the back surface of the end wall 30 of the knob 24. A finger 98 extends outwardly from the member 92 and is positioned to alternately engage the first and second position detents 80 and 82 upon each subsequent depression of the knob 24. Otherwise, the operation of the switch 10 shown in FIG. 4 is identical to that described above for the embodiment shown in FIGS. 1–3.

Another embodiment of a push—push switch 110 is shown in FIGS. 5A–5E. In this embodiment, the switch 110 includes two separately movable pushbuttons including a first pushbutton 112 labeled "P" for park and a second pushbutton 114 labeled "H" for headlights. Each pushbutton 112 and 114 is formed with an enlarged head mounted on one end of a slidable guide member 116 and 118, respectively. A first biasing spring 119 is seated between a first fixed support 120 in a switch housing, not shown, and the head of the pushbutton 112. A separate biasing spring 122 is seated between a second fixed support 121 and the head of the second pushbutton 114. The biasing springs 119 and 122 normally bias the pushbuttons 112 and 114, respectively, to a first release or outermost position shown in FIG. 5A. An outward extending flange 123 on the head of the first pushbutton 112 and a similar flange 125 on the head of the second pushbutton 114 engage a stationary face plate 124 to limit the amount of outward extension of the pushbuttons 112 and 114 in the first position.

Figure 5A:
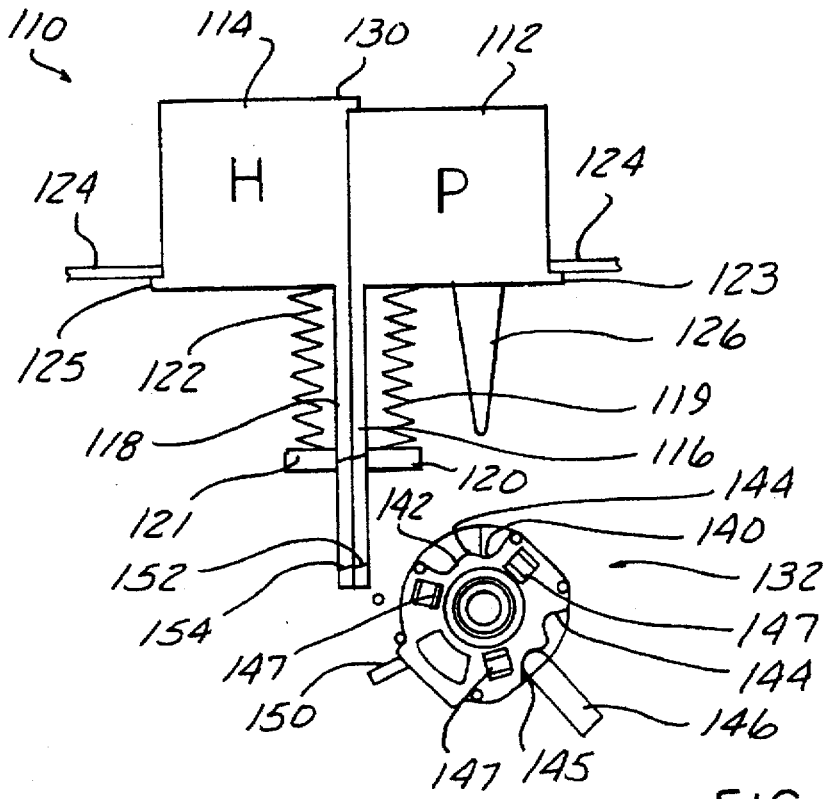
FIGS. 5A–5E are pictorial representations of the sequence of operation of another embodiment of a push—push switch constructed in accordance with the teachings of the present invention.

As shown in FIG. 5A, the second pushbutton 114 has an extension 130 which overlies the end of the first pushbutton 112. In this manner, the first pushbutton 112 may be depressed separately from the second pushbutton 114. However, depression of the second pushbutton 114 automatically depresses the first pushbutton 112.

Figure 5B:
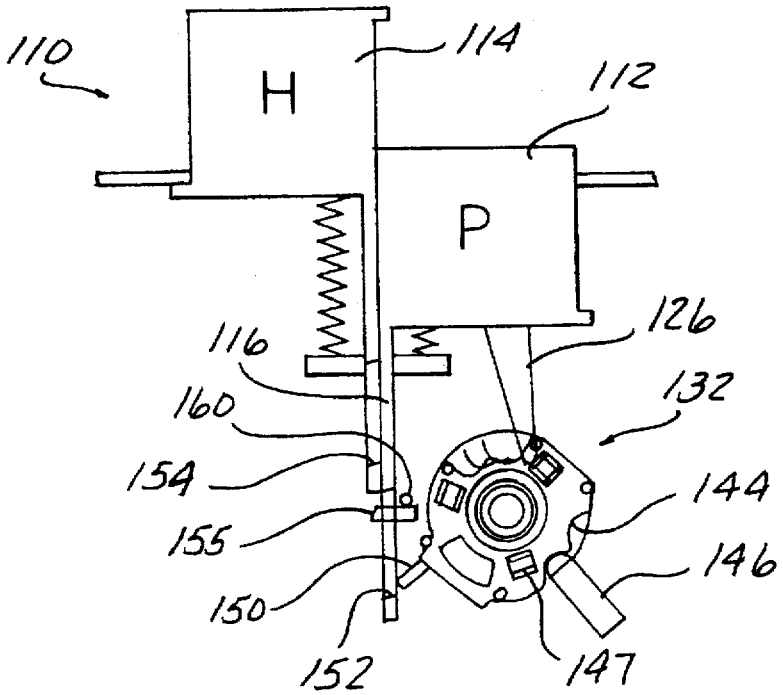
Figure 5C:
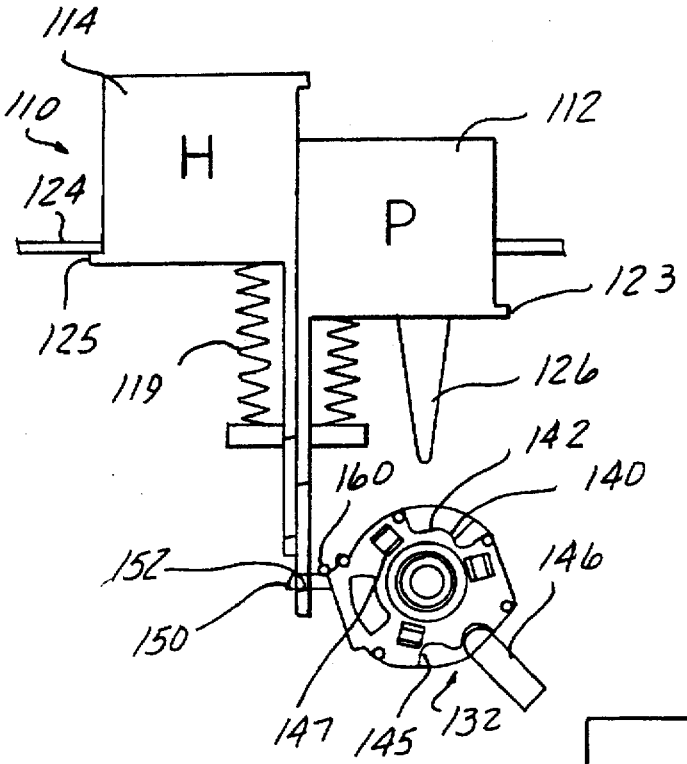
Figure 5D:
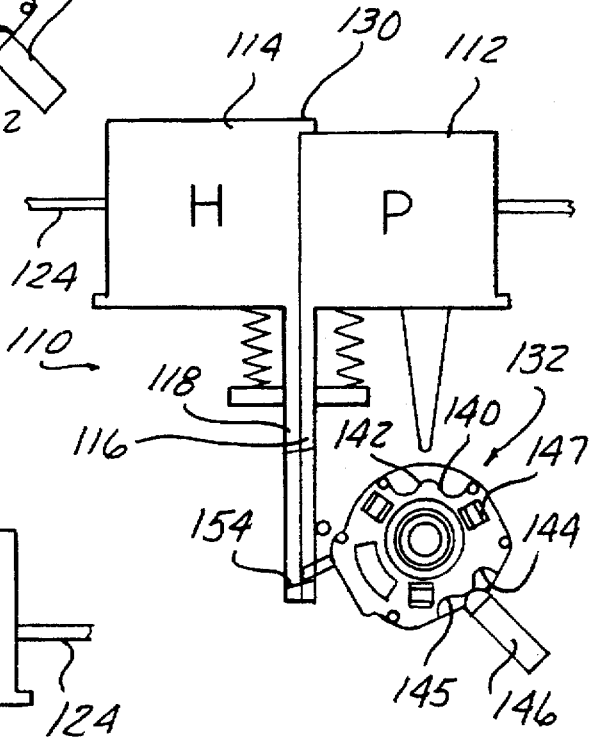
Figure 5E:
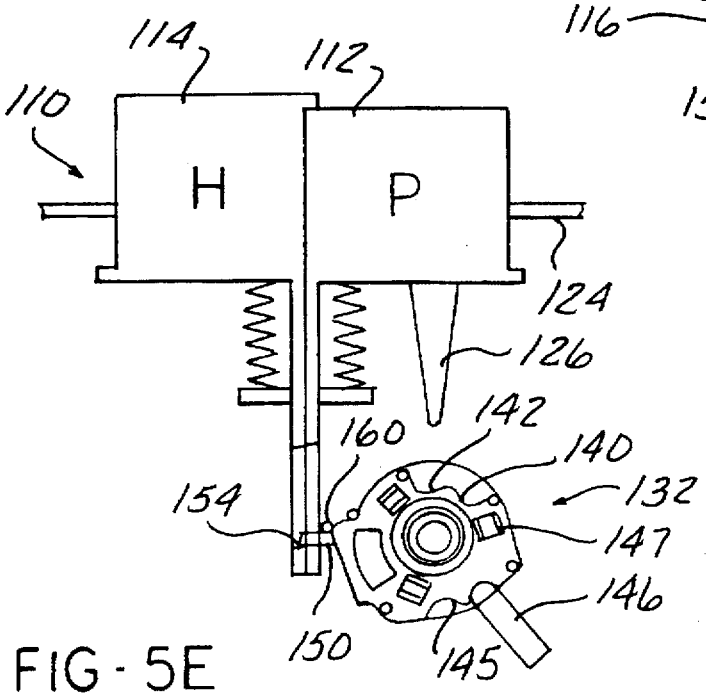

A bi-stable latch 132 is rotatably mounted in the housing and is movable from a first position shown in FIG. 5A to a second latched position shown in FIGS. 5C or 5E alternatingly upon each movement of the first pushbutton 112. One end of a resilient, flexible finger 126 projecting from the head of the first pushbutton 112 is normally spaced from, but is slidingly engagable with a detent profile formed on the latch 132. The detent profile includes first and second detents 140 and 142 disposed on opposite sides of a central projection 144.

A spring biased detent plunger 146 is positioned to engage spaced detents 144 and 145 in another detent profile on the latch 132. A plurality of contacts 147 are mounted on the latch 132 and engage or disengage conductive traces on a circuit board, not shown, which is positioned adjacent to the latch 132. A separate contact, not shown, is carried in the second pushbutton 114 and engages other conductive traces on the circuit board to control the vehicle headlight operation.

A latch projection 150 extends radially outward from the latch 132. The latch projection 150 is releasibly extendible into apertures 152 and 154 in the guide members 116 and 118, respectively, upon successive depressions of the pushbuttons 112 and 114 as described hereafter.

In operation, a first depression of the first pushbutton 112 causes the finger 126 to engage the detent 140 in the latch 132 thereby rotating the latch 132 from the position in FIG. 5A to the position shown in FIG. 5B. During such movement, the finger 126 exhibits a sideways, slightly pivotal movement.

During the depression or advance of the first pushbutton 112 as shown in FIG. 5B, the endmost edge of the aperture 152 in the guide member 116 slides past the latch projection 150 just as the latch projection 150 begins its clockwise rotative movement with the latch 132. When the finger 126 has completed its full advance movement and has rotated the latch member 132 fully to the second position as shown in FIG. 5B, the latch projection 150 will have assumed the position partially shown in FIG. 5B by reference number 155 wherein the outermost end of the latch projection 150 is situated within the aperture 152 and the guide member 116 of the first pushbutton 112. At this time, the detent plunger 146 will have disengaged from the detent 145 and engaged the other detent 144 as shown in FIG. 5C.

Release of the first pushbutton 112 as shown FIG. 5C enables biasing spring 119 to urge the first pushbutton 112 outward relative to the support 124 to the position shown in FIG. 5C intermediate the first and second positions of the first pushbutton 112. However, the latch projection 150 will engage the edge of the aperture 152 thereby retaining the first pushbutton 112 in a partially depressed position shown in FIG. 5C. Further, it will be understood that during such movement of the first pushbutton 112, rotation of latch 132 enables the contacts 147 carried on the latch 132 to switch connections with conductive traces on the printed circuit board, not shown, to activate the vehicle park lights in a conventional manner.

FIG. 5D shows a subsequent depression of the second pushbutton 114. During the initial depression or advance of the guide member 118 on the second pushbutton 114, the outermost end of the guide member 118 will contact the end of the latch projection 150 which, as shown in FIG. 5B, extends into the path of movement of the guide member 118. The guide member 118 will rotate the latch 132 counterclockwise in the orientation shown in FIG. 5D to an intermediate position in which the detent plunger 146 is situated just to one side of the central projection between the two detents 144 and 145 until the end of the guide member 118 clears the latch projection 150. The latch 132 then rotates clockwise under the spring bias of the detent plunger 146 as the detent plunger 146 moves back into engagement with the detent 144. This moves the latch projection 150 into the aperture 154 in the guide member 118 enabling the latch projection 150 to engage the edge of the aperture 154 and retain the second pushbutton 114 in the partially depressed state after the user releases the depression force on the second pushbutton 114. This partially depressed state is shown in FIG. 5E.

A stop 160 is mounted on the switch housing to limit or stop rotation of the latch projection and thereby the latch 132 when the latch projection 150 reaches the second position.

Although a sequential operation of the first and second pushbuttons 112 and 114 has been described, it will be obvious that both pushbuttons 112 and 114 can be simultaneously depressed or that the second pushbutton 114 can be depressed first which will thereby simultaneously depress the first pushbutton 112 through the interconnection of the pushbuttons 112 and 114 by the overlaying flange 130. The same sequence of rotation of the latch 132 and the switching of contacts 147 thereby takes place when the second pushbutton 114 is depressed or both pushbuttons 112 and 114 are simultaneously depressed.

Referring now to FIG. 5E, when it is desired to turn the park or lights off, the user depresses the park or first pushbutton 112 a small amount. This will engage the finger 126 with the detent 142 in the latch 132 and rotate the latch 132 and counterclockwise until the latch projection 150 clears the aperture 152 in the guide member 116 on the first pushbutton 112. A subsequent release of the first pushbutton 112 enables the first pushbutton 112 under the influence of the biasing spring 119 to extend fully outward to the first outward position shown in FIG. 5A. Due to the overlaying flange 130 on the second pushbutton 114, the second pushbutton 114 also is simultaneously moved by the spring 122 to the first outward position shown in FIG. 5A.

In summary, there has been disclosed a unique push-switch which has a unique lock mechanism to lock a pushbutton or knob in a depressed position. The inventive switch is of simple construction and has a low sensitivity to tolerance variations and bent or misconfigured components.

What is claimed is:

1. A switch apparatus comprising:

a support;

a first member movably mounted relative to the support from movement between a first position and a second position, a bore formed in the first member transverse to a path of axial movement of the first member;

biasing means for normally biasing the first member to the first position with respect to the support;

a latch member movably mounted with respect to the first member, the latch member including a projection;

the latch member movable between first and second positions, the projection engaged with the bore in the first member when the first member and the latch member are in the first position to lock the first member in the first position and is disengagable from the bore in the first member when the first member is axially advanced from the first position to release the first member for movement to the second position;

means, operable upon each movement of the first member toward the first position, for alternatingly moving the latch member between the first and second positions upon each movement of the first member; and means independent from the first member, for retaining the latch member in a last one of the first and second positions, upon each movement of the latch member between the first and second positions.

2. A switch apparatus comprising:

a support;

a first member movably mounted relative to the support from movement between a first position and a second position, a bore formed in the first member transverse to a path of axial movement of the first member;

biasing means for normally biasing the first member to the first position with respect to the support;

a latch member movably mounted with respect to the first member, the latch member including a projection;

the latch member movable between first and second positions, the projection engaged with the bore in the first member when the first member and the latch member are in the first position to lock the first member in the first position and is disengagable from the bore in the first member when the first member is axially advanced from the first position to release the first member for movement to the second position;

means, operable upon movement of the first member toward the second position, for moving the latch member between the first and second positions upon each movement of the first; and means for retaining the latch member in a last one of the first and second positions, the retaining means including:

a plurality of retaining detents formed on the latch member; and a plunger fixed at a first end and having a second end releasibly engagable in one of the retaining detents upon movement of the latch member between the first and second positions.

3. A switch apparatus comprising:

a support;

a first member movably mounted relative to the support from movement between a first position and a second position, a bore formed in the first member transverse to a path of axial movement of the first member;

biasing means for normally biasing the first member to the first position with respect to the support;

a latch member movably mounted with respect to the first member, the latch member including a projection;

the latch member movable between first and second positions, the projection engaged with the bore in the first member when the first member and the latch member are in the first position to lock the first member in the first position and is disengagable from the bore in the first member when the first member is axially advanced from the first position to release the first member for movement to the second position;

means, operable upon movement of the first member toward the second position, for moving the latch member between the first and second positions upon each movement of the first member, the moving means including:

first and second detents formed on the latch member; and means, carried on the first member, for alternately engaging one of the first and second detents upon each movement of the first member.

4. The switch apparatus of claim 3 wherein the engaging means is movably carried on the first member.

5. The switch apparatus of claim 4 wherein the engaging means is pivotally connected to the first member.

6. The switch apparatus of claim 5 wherein the engaging means comprises:

an arm integral with the first member.

7. The switch apparatus of claim 6 wherein the arm is connected to the first member by a living hinge.

8. The switch apparatus of claim 6 wherein:

the support is a carrier;

the first member having a stem, the bore formed in the stem; and the biasing means disposed between the carrier and the first member.

9. The switch apparatus of claim 8 further comprising:

guide means, formed on the carrier and engagable with the stem on the first member, for guiding movement of the first member relative to the carrier.

10. The switch apparatus of claim 9 wherein:

the carrier includes a base;

a tubular extension extending from the base; and the guide means includes a bore formed in the tubular extension, the stem slidably disposed on the bore.

11. The switch apparatus of claim 10 further comprising:

means for fixedly coupling the stem to the tubular extension for equal rotation of the stem and the carrier.

12. The switch apparatus of claim 10 wherein the coupling means comprises:

the stem and the bore on the tubular extension having complementary cross-sections.

13. The switch apparatus of claim 8 wherein the carrier is mounted on a surface.

14. The switch apparatus of claim 13 wherein the carrier is rotatably mounted on a surface.

15. The switch apparatus of claim 8 further comprising:

means for coupling the stem and the carrier for simultaneous rotation upon rotation of the first member.

16. A switch apparatus comprising:

a support;

a first member movably mounted relative to the support from movement between a first position and a second position, a bore formed in the first member transverse to a path of axial movement of the first member;

biasing means for normally biasing the first member to the first position with respect to the support;

a latch member movably mounted with respect to the first member, the latch member including a projection;

the latch member movable between first and second positions, the projection engaged with the bore in the first member when the first member and the latch member are in the first position to lock the first member in the first position and is disengagable from the bore in the first member when the first member is axially advanced from the first position to release the first member for movement to the second position;

means, operable upon movement of the first member toward the second position, for moving the latch member between the first and second positions upon each movement of the second member;

a second member disposed adjacent to the first member and movably mounted relative to the support for movement between a first position and a second position, a bore formed in the second member transverse to a path of axial movement of the second member;

biasing means for biasing the second member to the first position with respect to the support; and the projection on the latch member engaging the transverse bore in the second member when the second member and the latch member are in the second position.

17. The switch apparatus of claim 16 further comprising:

means for retaining the latch member in a last moved one of the first and second positions.

18. The switch apparatus of claim 16 wherein the moving means comprises:

first and second detents formed on the latch member; and means, carried on the first member, for alternately engaging one of the first and second detents upon each axial movement of the first member toward the second position.

19. The switch apparatus of claim 18 wherein:

the engaging means is movably carried on the first member.

20. The switch apparatus of claim 16 wherein:

the second member has an outwardly extending portion engagable with the first member when the first and second members are in the respective first positions, the outwardly extending portion effecting simultaneous movement of the first member with the second member when the first and second members are in the first positions and the second member is moved axially toward the second position.

21. A switch apparatus comprising:

a carrier;

a knob movably mounted relative to the carrier, the knob having a stem, a bore formed in the stem;

biasing means, disposed between the carrier and the knob, for normally biasing the knob to a first position with respect to the carrier;

a latch member movably mounted on the carrier, the latch member including a projection;

the latch member movable between first and second positions, the projection engaged with the bore in the stem when the latch member and the knob are in a first position to lock the knob in the first position and is disengagable from the bore in the stem when the knob is moved from the first position to release the knob for movement to the second position; and means, operable upon movement of the knob toward the carrier, for alternatingly moving the latch member between the first and second positions upon each movement of the knob, the moving means including:

first and second detents formed on the latch member; and means, carried on the knob for alternately engaging one of the first and second detents upon each movement of the knob; and means for releasibly retaining the latch member in a last moved one of the first and second positions.

22. The switch apparatus of claim 21 wherein the retaining means comprises:

a plurality of retaining detents formed on the latch member; and a plunger mounted on the carrier and releasibly engagable in one of the retaining detents upon movement of the latch member between the first and second positions.

23. The switch apparatus of claim 22 wherein the engaging means is movably carried on the knob.

24. The switch apparatus of claim 22 wherein the engaging means is pivotally connected to the knob.

25. The switch apparatus of claim 24 wherein the engaging means comprises:

an arm integral with the knob.

26. The switch apparatus of claim 25 wherein the arm is connected to the knob by a living hinge.

27. A switch apparatus comprising:

a fixed support;

a first member movably mounted relative to the support for movement between a first position and a second position, a bore formed in the first member transverse to a path of axial movement of the first member;

a second member mounted adjacent to the first member relative to the support for movement between a first position and a second position, a bore formed in the second member transverse to a path of axial movement of the second member;

biasing means for normally biasing the first member and the second member to the first positions with respect to the support;

a latch member movably mounted with respect to the first and second members, the latch member including a projection;

the latch member movable between first and second positions, the projection engagable with the transverse bores in the first and second members when the first and second members are in the first position and the latch member is in the second position to lock the first and second members in the first position, and is disengagable from the bores in the first and second members when at least one of the first and second members is axially advanced from the first position to release the first and second members for movement to the second position; and means, carried by the first member and operable upon movement of the first member towards the second position, for moving the latch member between the first and second positions upon each movement of the first member toward the second position.

28. The switch apparatus of claim 27 further comprising:

the second member has an outwardly extending portion engagable with the first member when the first and second members are in the respective first positions, the outwardly extending portion effecting simultaneous movement of the first member with the second member when the first and second members are in the first positions and the second member is moved axially toward the second position.

29. A switch apparatus comprising:

a support;

a first member movably mounted relative to the support from movement between a first position and a second position, a bore formed in the first member transverse to a path of axial movement of the first member;

biasing means for normally biasing the first member to the first position with respect to the support;

a latch member movably mounted with respect to the first member, the latch member movable between first and second positions, the latch member engaged with the bore in the first member when the first member and the latch member are in the first position to lock the first member in the first position and is disengagable from the bore in the first member when the first member is axially advanced from the first position to release the first member for movement to the second position;

means, operable upon each movement of the first member toward the first position, for alternatingly moving the latch member between the first and second positions; and means, independent from the first member, for retaining the latch member in a last one of the first and second positions, upon each movement of the latch member between the first and second positions.

30. A switch apparatus of claim 29 wherein:

wherein the moving means is movably carried on the first member.

* * * * *